US011635069B2

(12) United States Patent
Lee et al.

(10) Patent No.: US 11,635,069 B2
(45) Date of Patent: Apr. 25, 2023

(54) HERMETIC COMPRESSOR WITH DISCHARGE VALVE PLATE EDGES AND DISCHARGE VALVE STOPPER ALIGNED ALONG A CURVED VIRTUAL LINE

(71) Applicant: LG ELECTRONICS INC., Seoul (KR)

(72) Inventors: Kiyeon Lee, Seoul (KR); Seungwook Kim, Seoul (KR); Kyeongho Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/462,358

(22) Filed: Aug. 31, 2021

(65) Prior Publication Data

US 2022/0112890 A1 Apr. 14, 2022

(30) Foreign Application Priority Data

Oct. 12, 2020 (KR) ..... 10-2020-0131277

(51) Int. Cl.
*F04B 39/10* (2006.01)

(52) U.S. Cl.
CPC ..... *F04B 39/1066* (2013.01); *F04B 39/1046* (2013.01); *F04B 39/1073* (2013.01)

(58) Field of Classification Search
None
See application file for complete search history.

(56) References Cited

U.S. PATENT DOCUMENTS

2018/0223822 A1* 8/2018 Lee ..... F04B 7/04

FOREIGN PATENT DOCUMENTS

| | | | |
|---|---|---|---|
| CN | 201696259 | | 1/2011 |
| CN | 201696259 U | * | 1/2011 |
| DE | 42 26 587 | | 2/1993 |
| EP | 2 847 463 | | 3/2015 |
| JP | 2011-520059 | | 7/2011 |
| KR | 10-2003-0083367 | | 10/2003 |

(Continued)

OTHER PUBLICATIONS

Korean Office Action issued in Application No. 10-2020-0131277 dated Oct. 26, 2021.

(Continued)

*Primary Examiner* — Nathan C Zollinger
*Assistant Examiner* — Geoffrey S Lee
(74) *Attorney, Agent, or Firm* — KED & Associates

(57) ABSTRACT

A hermetic compressor equipped with a valve assembly may include a valve plate having one suction port and a plurality of discharge ports; a suction valve provided at a first surface of the valve plate; a discharge valve provided at a second surface of the valve plate and having one fixing portion and a plurality of opening and closing portions that extends from the one fixing portion to respectively open and close the plurality of discharge ports; and a valve stopper that is fixed to the valve plate and limits a degree of opening of the opening and closing portions of the discharge valve. Accordingly, the opening and closing portions of the discharge valve may be reduced in size to thereby reduce inertia of the discharge valve. Thus, response of the discharge valve may be increased while simplifying a structure and assembly of the discharge valve.

20 Claims, 11 Drawing Sheets

(56) References Cited

FOREIGN PATENT DOCUMENTS

| | | | | | |
|---|---|---|---|---|---|
| KR | 10-2006-0004102 | | | 1/2006 | |
| KR | 2006004102 | A | * | 1/2006 | ..... F04B 39/0005 |
| KR | 10-1203584 | | | 11/2012 | |
| KR | 101203584 | B1 | * | 11/2012 | ..... F04B 39/121 |
| WO | WO 2014/088695 | | | 6/2014 | |
| WO | WO-2014088695 | A1 | * | 6/2014 | ..... F04B 27/1009 |
| WO | WO 2020/059996 | | | 3/2020 | |

OTHER PUBLICATIONS

German Office Action issued in Application No. 102021120639.1 dated Apr. 20, 2022.

* cited by examiner

HERMETIC COMPRESSOR WITH DISCHARGE VALVE PLATE EDGES AND DISCHARGE VALVE STOPPER ALIGNED ALONG A CURVED VIRTUAL LINE

CROSS-REFERENCE TO RELATED APPLICATION(S)

Pursuant to 35 U.S.C. § 119(a), this application claims the benefit of the earlier filing date and the right of priority to Korean Patent Application No. 10-2020-0131277, filed in Korea on Oct. 12, 2020, the contents of which are incorporated by reference herein in their entirety.

BACKGROUND

1. Field

A hermetic compressor with a discharge valve assembly is disclosed herein.

2. Background

A hermetic compressor is a compressor in which both a motor unit and a compression unit that define a compressor body are installed at an inner space of a shell. Hermetic compressors are classified into a reciprocating type, a rotary type, a vane type, and a scroll type according to a method of compressing a refrigerant.

In general, a suction valve and a discharge valve are separately provided in a rotary compressor, a vane compressor, and a scroll compressor, whereas a valve assembly made up of a suction valve and a discharge valve is provided in a reciprocating compressor. In a reciprocating compressor, when a suction valve and a discharge valve are separately provided, a valve installation space is relatively sufficient to thereby offer a high degree of design freedom. However, when a suction valve and a discharge valve are configured as one assembly, a valve installation space is small to thereby have a low degree of design freedom.

A reciprocating compressor in which a suction valve and a discharge valve are configured as one valve assembly is disclosed in Korean Patent Laid-Open Application No. 10-2003-0083367 (hereinafter, "Patent Document 1"), and Korean Patent Registered No. 10-1203584 (hereinafter, "Patent Document 2"), which are hereby incorporated by reference. A valve assembly having one discharge valve is disclosed in Patent Document 1, and a valve assembly provided with a pair of discharge valves is disclosed in Patent Document 2. As a smaller number of parts is required, having one discharge valve as in the case of Patent Document 1 is more suitable for manufacture and assembly of the valve assembly than having two discharge valves as in the case of Patent Document 2.

However, if a discharge capacity of the compressors is the same, a discharge port of Patent Document 1 should be wider (greater) than a discharge port of Patent Document 2. Then, stiffness of a discharge valve of Patent Document 1 should be greater than stiffness of a discharge valve of Patent Document 2, which increases inertia of the discharge valve of Patent Document 1. This may lead to a decrease in responsiveness of the discharge valve, causing compression loss.

BRIEF DESCRIPTION OF THE DRAWINGS

Embodiments will be described in detail with reference to the following drawings in which like reference numerals refer to like elements, and wherein.

DETAILED DESCRIPTION

Description will now be given of a hermetic compressor according to embodiments, with reference to the accompanying drawings. As described above, a hermetic compressor includes a discharge valve to confine a refrigerant in a compression chamber and to control compression and discharge of the refrigerant confined in the compression chamber. The discharge valve and a suction valve may be installed together or installed separately from each other depending on a compression method. In the embodiments disclosed herein, a connection type reciprocating compressor in which a discharge valve and a suction valve are installed together will be used as a representative example. However, it is not limited thereto, and embodiments disclosed herein may also be applied to any hermetic compressor to which a valve assembly made up of a discharge valve and a suction valve is employed.

Figure 1:
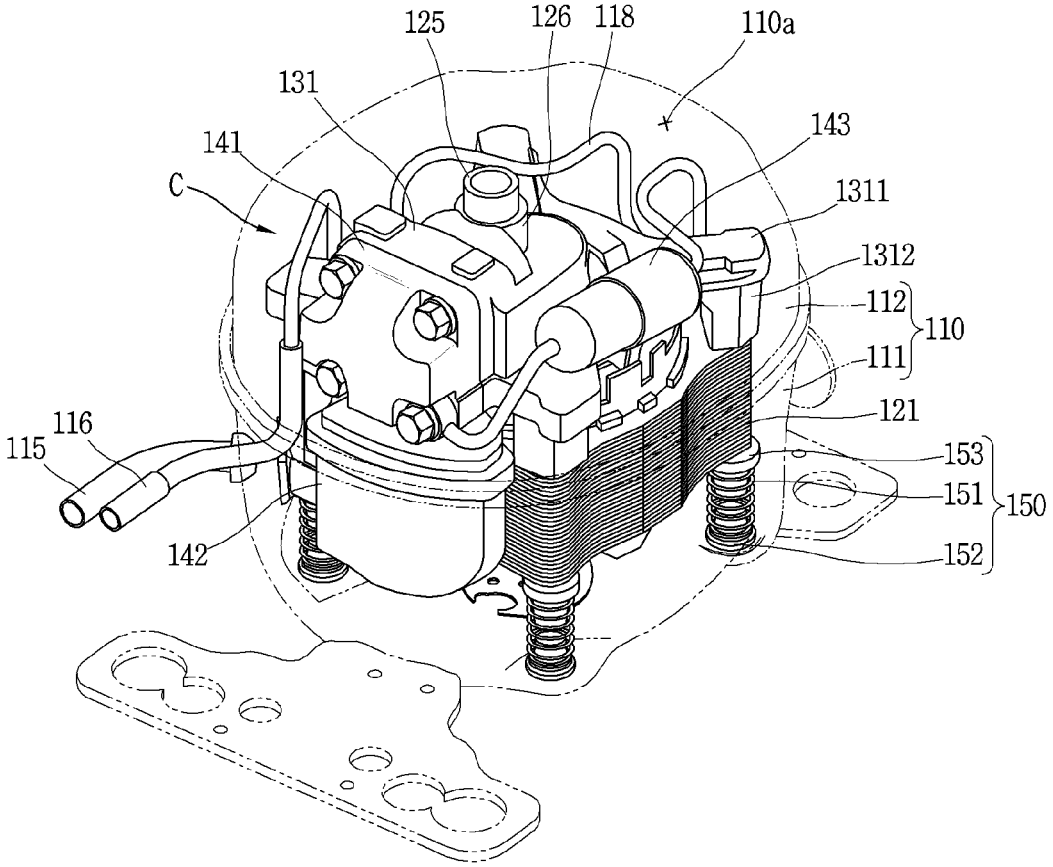
FIG. 1 is a see-through perspective view of a reciprocating compressor according to an embodiment.
Figure 2:
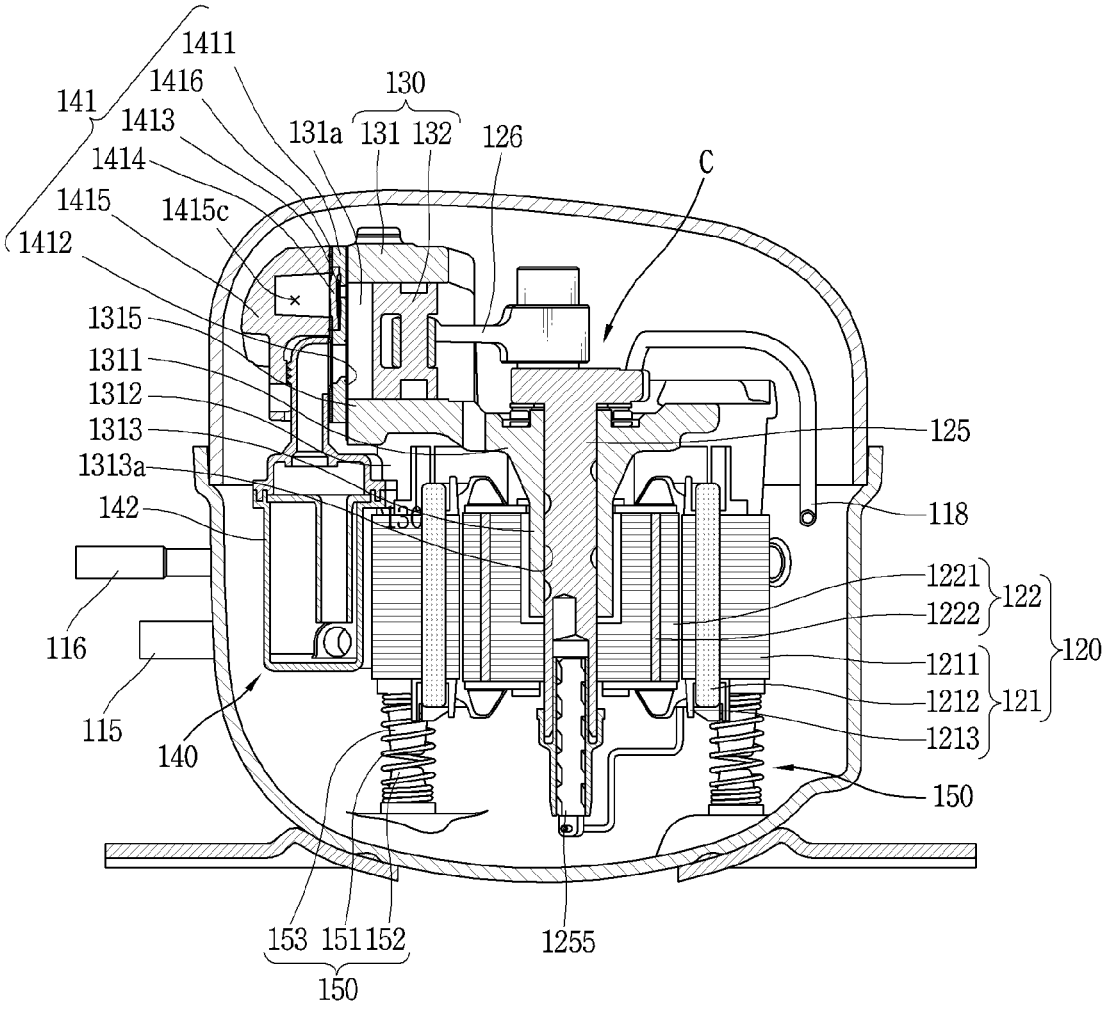
FIG. 2 is a cross-sectional view illustrating an inside of the reciprocating compressor of FIG. 1.

FIG. 1 is a see-through perspective view of a reciprocating compressor according to an embodiment. FIG. 2 is a cross-sectional view illustrating an inside of the reciprocating compressor of FIG. 1.

As illustrated in FIGS. 1 and 2, a reciprocating compressor according to an embodiment may include a shell 110 that defines an outer appearance, a motor unit (motor) 120 that is provided at an inner space 110*a* of the shell 110 and provides a drive force, a compression unit 130 that compresses refrigerant by receiving the drive force from the motor unit 120, a suction and discharge part or portion 140 that guides refrigerant to a compression chamber and discharges a compressed refrigerant, and a support part (support) 150 that supports a compressor body C including the motor unit 120 and the compression unit 130 with respect to the shell 110. The inner space 110*a* of the shell 110 may be sealed with the motor unit 120 and the compression unit 130 accommodated therein. The shell 110 may be made of an aluminum alloy (hereinafter, referred to as "aluminum"), for example, that is lightweight and has a high thermal conductivity, and may include a base shell 111 and a cover shell 112.

The base shell 111 may have a substantially hemisphere shape. A suction pipe 115, a discharge pipe 116, and a process pipe (not shown) may be coupled to the base shell 111 in a penetrating manner. The suction pipe 115, the discharge pipe 116, and the process pipe (not shown) may be coupled to the base shell 111 by, for example, insert die casting.

The cover shell 112 may have a substantially hemispherical shape like the base shell 111. The cover shell 112 may be coupled to an upper portion of the base shell 111 to define the inner space 110*a* of the shell 110.

The cover shell 112 and the base shell 111 may be coupled by, for example, welding. However, the base shell 111 and the cover shell 112 may be coupled by a bolt when they are made of an aluminum material that is not suitable for welding.

Hereinafter, the motor unit 120 will be described.

As illustrated in FIGS. 1 and 2, the motor unit 120 may include a stator 121 and a rotor 122. The stator 121 may be elastically supported with respect to the inner space 110*a* of the shell 110, namely, a bottom surface of the base shell 111, and the rotor 122 is rotatably installed inside of the stator 121.

In some embodiments, the stator 121 may include a stator core 1211 and a stator coil 1212. The stator core 1211 may be made of a metal material, such as an electrical steel sheet, and perform electromagnetic interaction with the stator coil 1212 and the rotor 122 described hereinafter through an electromagnetic force when a voltage is applied to the motor unit 120 from the outside.

In addition, the stator core 1211 may have a substantially rectangular cylinder shape. For example, an inner circumferential surface of the stator core 1211 may be formed in a circular shape, and an outer circumferential surface thereof may be formed in a rectangular shape. The stator core 1211 may be fixed to a lower surface of a cylinder block 131 by, for example, a stator fastening bolt (not shown).

Further, a lower end of the stator core 1211 may be supported by a support spring 151 described hereinafter with respect to a bottom surface of the shell 110 in a state in which the stator core 1211 is axially and radially spaced apart from an inner surface of the shell 110. This may prevent vibration generated during operation from being directly transferred to the shell 110.

The stator coil 1212 may be wound inside of the stator core 1211. As described above, when a voltage is applied from the outside, the stator coil 1212 generates an electromagnetic force to perform electromagnetic interaction with the stator core 1211 and the rotor 122. This may allow the motor unit 120 to generate a drive force for the compression unit 130 to perform a reciprocating motion.

An insulator 1213 may be disposed between the stator core 1211 and the stator coil 1212. This may prevent direct contact between the stator core 1211 and the stator coil 1212 to thereby facilitate the electromagnetic interaction.

In some embodiments, the rotor 122 may include a rotor core 1221 and magnets 1222. The rotor core 1221 may be made of a metal material, such as an electrical steel plate, for example, the same as that of the stator core 1211, and may have a substantially cylindrical shape. A crankshaft 125 described hereinafter may be, for example, press-fitted and coupled to a central portion or part of the rotor core 1221.

The magnets 1222 may be permanent magnets and be inserted into the rotor core 1221 at equal intervals along a circumferential direction of the rotor core 1221. When a voltage is applied, the rotor 122 is rotated by electromagnetic interaction with the stator core 1211 and the stator coil 1212. Then, the crankshaft 125 rotates together with the rotor 122, allowing a rotational force of the motor unit 120 to be transferred to the compression unit 130 through a connecting rod 126.

Hereinafter, the compression unit 130 will be described.

As illustrated in FIGS. 1 and 2, the compression unit 130 may include a cylinder block 131 and a piston 132. The cylinder block 131 may be elastically supported on the shell 110, and the piston 132 may be coupled to the crankshaft 125 by a connecting rod 126 to perform a relative motion with respect to the cylinder block 131.

In some embodiments, the cylinder block 131 may be provided at an upper portion of the motor unit 120. The cylinder block 131 may include a frame 1311, a fixing protrusion 1312 coupled to the stator 121 of the motor unit 120, a shaft receiving (or accommodating) portion 1313 that supports the crankshaft 125, and a cylinder unit 1315 that defines a compression chamber 131*a*.

The frame 1311 may have a flat plate shape extending in a horizontal direction, or a radial plate shape by processing a portion (or part) of an edge excluding corners to reduce weight or thickness. The fixing protrusion 1312 may be provided at an edge of the frame 1311. For example, the fixing protrusion 1312 may protrude from the edge of the frame 1311 toward the motor unit 120, namely in a downward direction.

The cylinder block 131 and the stator 121 may be coupled by the stator fastening bolt (not shown) to be elastically supported on the base shell 111 together with the stator 121 of the motor unit 120.

The shaft receiving portion 1313 may extend from a central portion of the frame 1311 in both directions of an axial direction. A shaft receiving hole 1313*a* may be axially formed through the shaft receiving portion 1313 so as to allow the crankshaft 125 to penetrate therethrough, and a bush bearing may be inserted and coupled to an inner circumferential surface of the shaft receiving hole 1313*a*.

The cylinder unit (hereinafter, referred to as "cylinder") 1315 may be radially eccentric from one edge of the frame 1311. The cylinder 1315 may radially penetrate through the cylinder block 131 so that the piston 132 connected to the connecting rod 126 is inserted into an inner open end thereof, and a valve assembly 141 forming the suction and discharge part 140 described hereinafter may be inserted into an outer open end thereof.

In some embodiments, the piston 132 may be provided such that a side that faces the connecting rod 126 (a rear side) is open and an opposite side thereof, namely, a front side is closed. Accordingly, the connecting rod 126 may be inserted into the rear side of the piston 132 to be rotatably coupled, and the front side of the piston 132 may be formed in a closed shape to define the compression chamber 131*a* inside of the cylinder 1315 together with the valve assembly 141 described hereinafter.

In addition, the piston 132 may be made of the same material as the cylinder block 131, such as an aluminum alloy, for example. This may prevent a magnetic flux from being transmitted to the piston 132 from the rotor 122.

Further, as the piston 132 is made of the same material as the cylinder block 131, the piston 132 and the cylinder block (more precisely, the cylinder) 131 may have a same coefficient of thermal expansion. Accordingly, even when the inner space 110*a* of the shell 110 is in a high temperature condition (approximately 100° C.) during operation of the compressor, interference between the cylinder block 131 and the piston 132, caused by thermal expansion, may be suppressed or reduced.

Hereinafter, the suction and discharge part 140 will be described.

Figure 3:
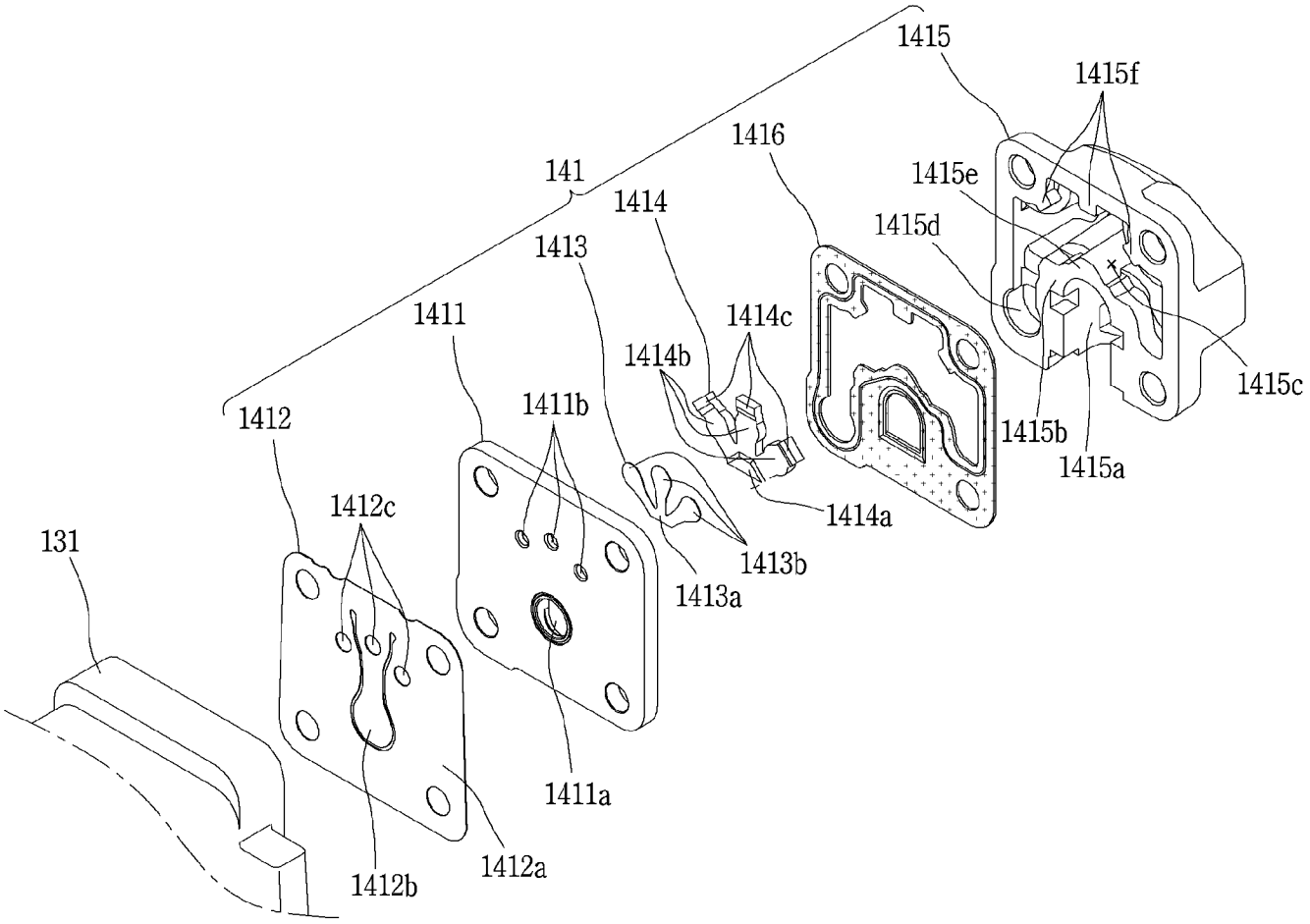
FIG. 3 is an exploded perspective view of a valve assembly according to an embodiment in FIG. 1 disassembled starting from a cylinder.
Figure 4:
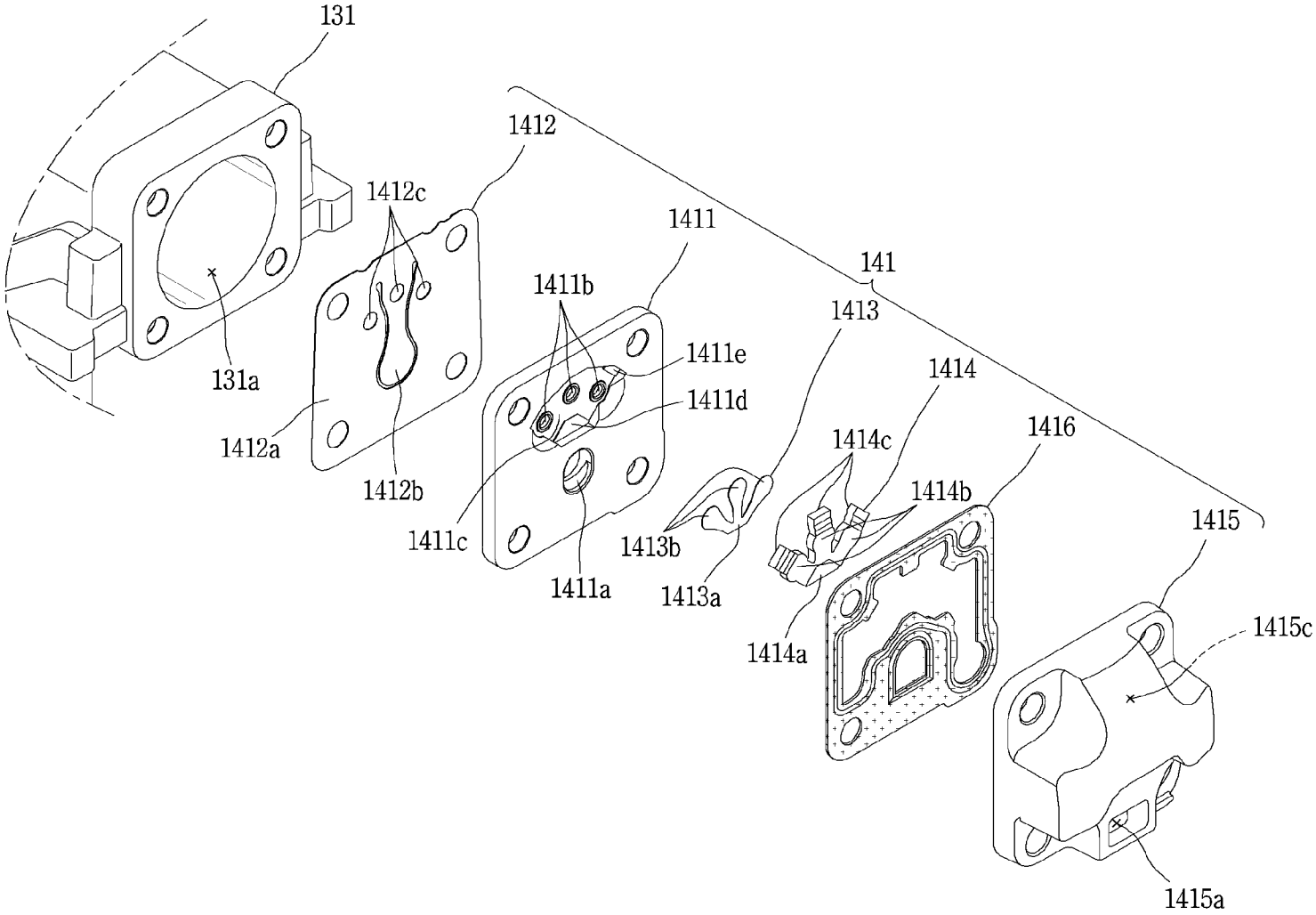
FIG. 4 is an exploded perspective view of the valve assembly in FIG. 1 disassembled starting from a discharge cover.

FIG. 3 is an exploded perspective view of a valve assembly in FIG. 1 disassembled starting from a cylinder. FIG. 4 is an exploded perspective view of the valve assembly in FIG. 1 disassembled starting from a discharge cover.

Referring back to FIGS. 1 and 2, the suction and discharge part 140 may include the valve assembly 141, a suction muffler 142, and a discharge muffler 143. The valve assembly 141 and the suction muffler 142 may be sequentially coupled from the outer open end of the cylinder 1315.

In some embodiments, the valve assembly 141 may include a valve plate 1411, a suction valve 1412, a discharge valve 1413, a valve stopper 1414, and a discharge cover 1415. Referring to FIGS. 3 and 4, the valve plate 1411 has a substantially rectangular plate shape and may be installed to cover a front-end surface of the cylinder block 131, namely, a front open surface of the compression chamber 131*a*. For example, a fastening hole (no reference numeral) is provided at each corner of the valve plate 1411, so as to be coupled to a fastening groove (no reference numeral) formed on the front-end surface of the cylinder block 131 by a bolt, for example.

The valve plate 1411 may be provided with one suction port 1411*a* and a plurality (three in the drawings) of discharge ports 1411*b*. The suction port 1411*a* may be formed at a central portion of the valve plate 1411, and the plurality of discharge ports 1411*b* may be formed along a circumference of the suction port 1411*a* spaced apart by predetermined intervals (or gaps). The valve plate 1411 will be described hereinafter together with a discharge system including the discharge valve 1413.

Referring to FIGS. 3 and 4, the suction valve 1412 may be disposed at a side facing the cylinder block 131 with respect to the valve plate 1411. Accordingly, the suction valve 1411 may be bent in a direction toward the piston 132 to be opened and closed.

For example, the suction valve 1412 may be made of a steel plate which is thinner than the valve plate 1411 and has a rectangular plate shape the same as that of the valve plate 1411, so as to be coupled to the cylinder block 131 together with the valve plate 1411. An opening and closing portion at a suction side (hereinafter, referred to as "opening and closing portion") 1412*b* that opens and closes the suction port 1411*a* of the valve plate 1411 may be formed at a central portion of the suction valve 1412. Accordingly, an edge of the suction valve 1412 defines a fixing portion at the suction side (hereinafter, referred to as "fixing portion") 1412*a*, and a central portion thereof defines the opening and closing portion 1412*b*.

In addition, discharge through-holes 1412*c* in communication with the discharge ports 1411*b* of the valve plate 1411 may be formed in the suction valve 1412. The discharge through-hole 1412*c* may be provided at a position corresponding to the discharge port 1411*b*. For example, when three discharge ports 1411*b* are formed in the valve plate 1411 spaced apart by predetermined intervals along a circumferential direction, three discharge through-holes 1412*c* may be provided in the suction valve 1412 spaced apart by predetermined intervals along the circumferential direction. Accordingly, the three discharge through-holes 1412*c* may communicate with the three discharge ports 1411*b*, respectively.

At least one of the three discharge through-holes 1412*c* may be formed at the opening and closing portion 1412*b* of the suction valve 1412. Accordingly, a stiffness (or rigidity) of the opening and closing portion 1412*b* of the suction valve 1412 may be reduced, allowing the opening and closing portion 1412*b* of the suction valve 1412 to be quickly opened. This may lead to a decrease in suction loss.

Referring to FIGS. 3 and 4, the discharge valve 1413 may be disposed at an opposite side of the cylinder block 131 with respect to the valve plate 1411. Accordingly, the discharge valve 1413 may be bent in a direction that does not face the piston 132 to be opened and closed.

For example, the discharge valve 1413 may be made of a thin steel plate the same as that of the suction valve 1412 and may have a radial shape so as to simultaneously open and close the plurality of discharge ports 1411*b*. In other words, the discharge valve 1413 according to embodiments may be provided with a plurality of opening and closing portions at a discharge side (hereinafter, referred to as "opening and closing portions of the discharge valve" or "opening and closing portions" or "flaps) 1413*b* so as to correspond to the plurality of discharge ports 1411*b*, and the plurality of opening and closing portions 1413*b* may be formed in a radial shape that extends from one fixing portion at the discharge side (hereinafter, referred to as "fixing portion of the discharge valve" or "fixing portion" or "fixed end") 1413*a*. The discharge valve 1413 will be discussed hereinafter, together with the discharge system.

Referring to FIGS. 3 and 4, the valve stopper 1414 may be disposed between the valve plate 1411 and the discharge cover (more precisely, a gasket described hereinafter) 1415 with the discharge valve 1413 interposed therebetween. The valve stopper 1414 may be fixed by being pressed by the discharge cover 1415 in a state in which one end thereof is in contact with the fixing portion 1413*a* of the discharge valve 1413. Accordingly, the fixing portion 1413*a* of the discharge valve 1413 may be fixed to the valve plate 1411 by being pressed by the valve stopper 1414. The valve stopper 1414 will be described again hereinafter, together with the discharge system.

Referring to FIGS. 3 and 4, the discharge cover 1415 and the suction valve 1412 may be coupled to the front-end surface of the cylinder block 131 with the valve plate 1411 interposed therebetween, allowing the compression chamber 131*a* to be finally covered by the discharge cover 1415. Therefore, the discharge cover 1415 may also be referred to as a "cylinder cover".

A muffler fixing portion 1415*a* may be provided at a central portion of the discharge cover 1415 to support a connection portion (not shown) of the suction muffler 142 described hereinafter, and a discharge chamber 1415*c* may be provided in a periphery of the muffler fixing portion 1415*a* in a recessed manner with a partition wall portion or wall 1415*b* interposed therebetween. The discharge chamber 1415*c* may be connected to the discharge muffler 143 described hereinafter through a loop pipe 118.

In addition, a first stopper pressing portion 1415*e* and a second stopper pressing portion 1415*f* that press both ends of the valve stopper 1414 to fix the valve stopper 1414 between the valve plate 1411 and the discharge cover 1415 may be provided at an inner circumferential surface of the discharge chamber 1415*c*. The discharge cover 1415 including the first stopper pressing portion 1415*e* and the second stopper pressing portion 1415*f* will be described again hereinafter, together with the discharge system.

A gasket 1416 may be further provided between the discharge cover 1415 and the valve plate 1411. The gasket 1416 may have substantially the same shape as one surface of the discharge cover 1415 that faces the valve plate 1411.

Referring back to FIGS. 1 and 2, the suction muffler 142 transfers refrigerant suctioned through a suction pipe 115 to the compression chamber 131*a* of the cylinder 1315. The suction muffler 142 may be fixed by the valve assembly 141 to communicate with the suction port 1411*a* of the valve plate 1411.

The suction muffler 142 may be provided therein with a suction space portion or space (no reference numeral). An inlet (or entrance) of the suction space portion may communicate with the suction pipe 115 in a direct or indirect manner, and an outlet (or exit) of the suction space portion may directly communicate with a suction side of the valve assembly 141.

In some embodiments, the discharge muffler 143 may be installed separately from the cylinder block 131. The discharge muffler 143 may be provided therein with a discharge space portion or space (no reference numeral). An inlet of the discharge space portion may be connected to a discharge side of the valve assembly 141 by the loop pipe 118, and an outlet of the discharge space portion may be directly connected to a discharge pipe 116 by the loop pipe 118.

Hereinafter, the support part 150 will be described.

As illustrated in FIGS. 1 and 2, the support parts 150 may provide support between a lower surface of the motor unit 120 and a bottom surface of the base shell 111 that faces a lower surface the motor unit 120, and in general, support four corners of the motor unit 120 with respect to the shell 110.

In some embodiments, each of the support parts 150 may include a support spring 151, a first spring cap 152 that supports a lower end of the support spring 151, and a second spring cap 153. In other words, each support part 150 may define a unitary support assembly made up of the support spring 151, the first spring cap 152, and the second spring cap 153, and the unitary support assemblies may be installed along a periphery of the compressor body C spaced apart by predetermined intervals or gaps.

The support spring 151 may be a compression coil spring. The first spring cap 152 may be fixed to the bottom surface of the base shell 111 to support the lower end of the support spring 151, and the second spring cap 153 may be fixed to a lower end of the motor unit 120 to support an upper end of the support spring 151. Accordingly, the support springs 151 may be supported by the respective first spring caps 152 and the respective second spring caps 153, so as to elastically support the compressor body C with respect to the shell 110.

In the drawings, unexplained reference numeral 1255 denotes an oil feeder.

The reciprocating compressor according to embodiments described above may operate as follows.

That is, when power is applied to the motor unit 120, the rotor 122 rotates. When the rotor 122 rotates, the crankshaft 125 coupled to the rotor 122 rotates together, causing a rotational force to be transferred to the piston 132 through the connecting rod 126. The connecting rod 126 allows the piston 132 to perform a reciprocating motion in a frontward and rearward direction with respect to the cylinder 1315.

For example, when the piston 132 moves backward from the cylinder 1315, a volume of the compression chamber 131*a* increases. When the volume of the compression chamber 131*a* is increased, refrigerant filled in the suction muffler 142 passes through the suction valve 1412 of the valve assembly 141, and is then suctioned into the compression chamber 131*a* of the cylinder 1315.

In contrast, when the piston 132 moves forward from the cylinder 1315, the volume of the compression chamber 131*a* decreases. When the volume of the compression chamber 131*a* is decreased, refrigerant filled in the compression chamber 131*a* is compressed, passes through the discharge valve 1413 of the valve assembly 141, and is then discharged to the discharge chamber 1415*c* of the discharge cover 1415. This refrigerant flows into the discharge space portion of the discharge muffler 143 through the loop pipe 118 and is then discharged to a refrigeration cycle through the loop pipe 118 and the discharge pipe 116. Such series of processes may be repeated.

The discharge valve 1413 may be opened and closed by a pressure difference between the compression chamber 131*a* and the discharge chamber 1415*c*. For example, during a suction stroke of the piston 132, pressure in the compression chamber 131*a* is lower than pressure in the discharge chamber 1415*c*. Then, the discharge valve 1413 remains closed by the pressure of the discharge chamber 1415*c*.

On the other hand, during a discharge stroke of the piston 132, pressure in the compression chamber 131*a* is higher than pressure in the discharge chamber 1415*c*. Then, the discharge valve 1413 is pushed by the pressure of the compression chamber 131*a* to be bent with respect to the fixing portion 1413*a* described hereinafter, allowing the discharge valve 1413 to open. If a stiffness of the discharge valve 1413 is too high, a delay in opening of the discharge valve 1413 may occur, causing a sort of overshooting (or over-compression). This may result in an increase in compression loss.

As a plurality of the discharge port 1411*b* is provided, a cross section of individual discharge ports 1411*b* may be reduced while maintaining a cross section of the discharge ports 1411*b* as a whole. As a result, the stiffness of the discharge valve 1413 that opens and closes the individual discharge ports 1411*b* may be reduced to increase response or responsiveness of the discharge valve 1413, thereby suppressing a compression loss due to a delay in discharge.

Figure 5:
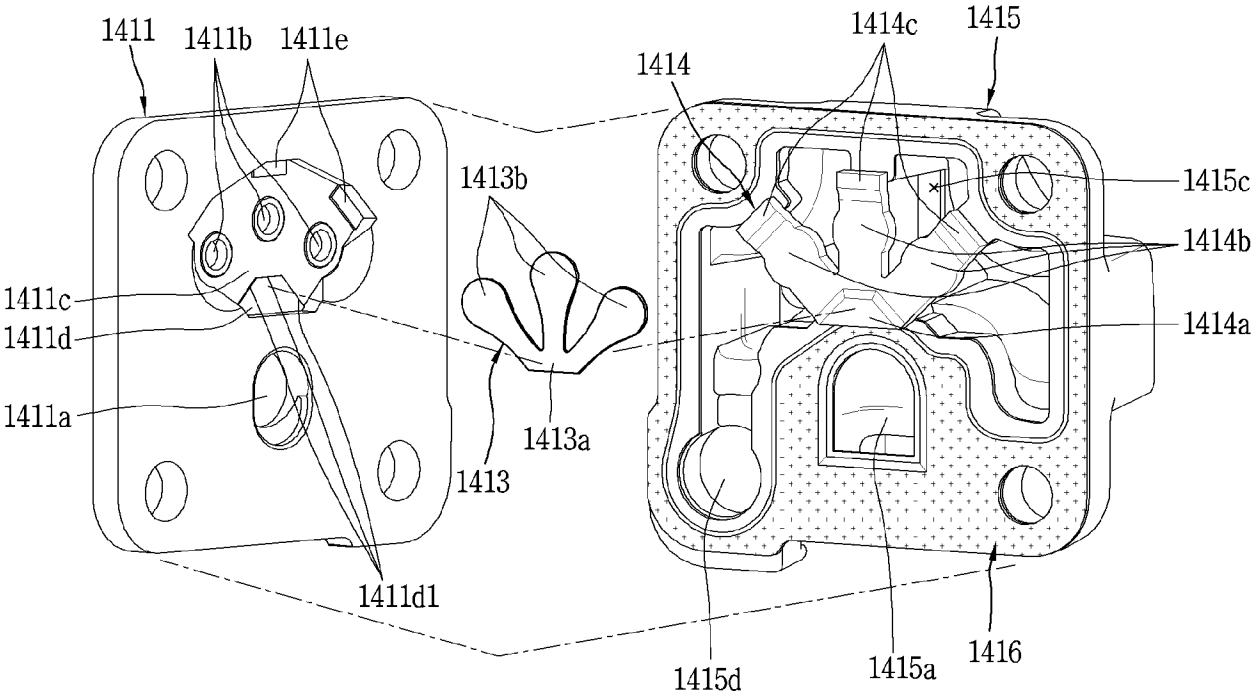
FIG. 5 is a perspective view illustrating components assembled or disassembled to or from the valve assembly in FIG. 3 or FIG. 4.
Figure 6:
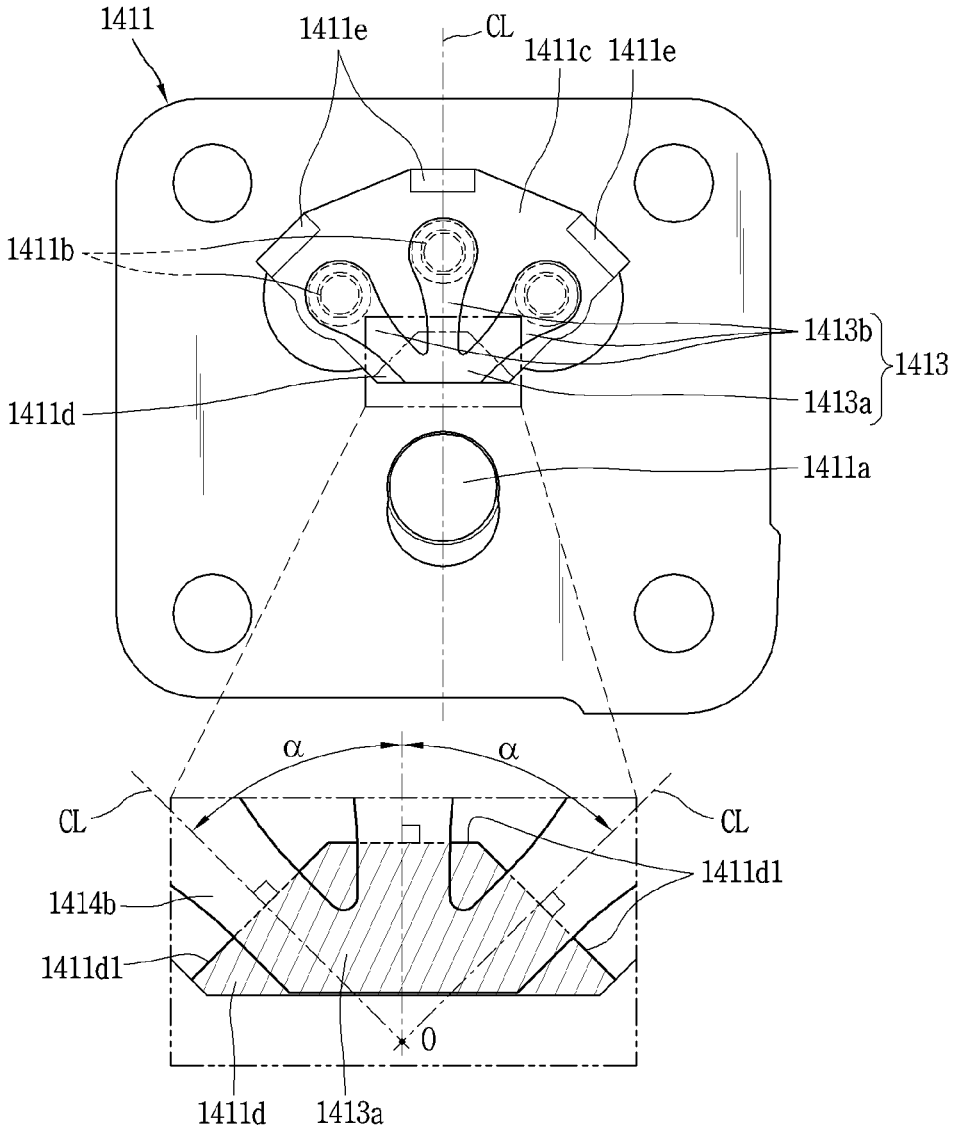
FIG. 6 is a planer view illustrating an assembled state between a valve plate and a discharge valve in FIG. 5.
Figure 7:
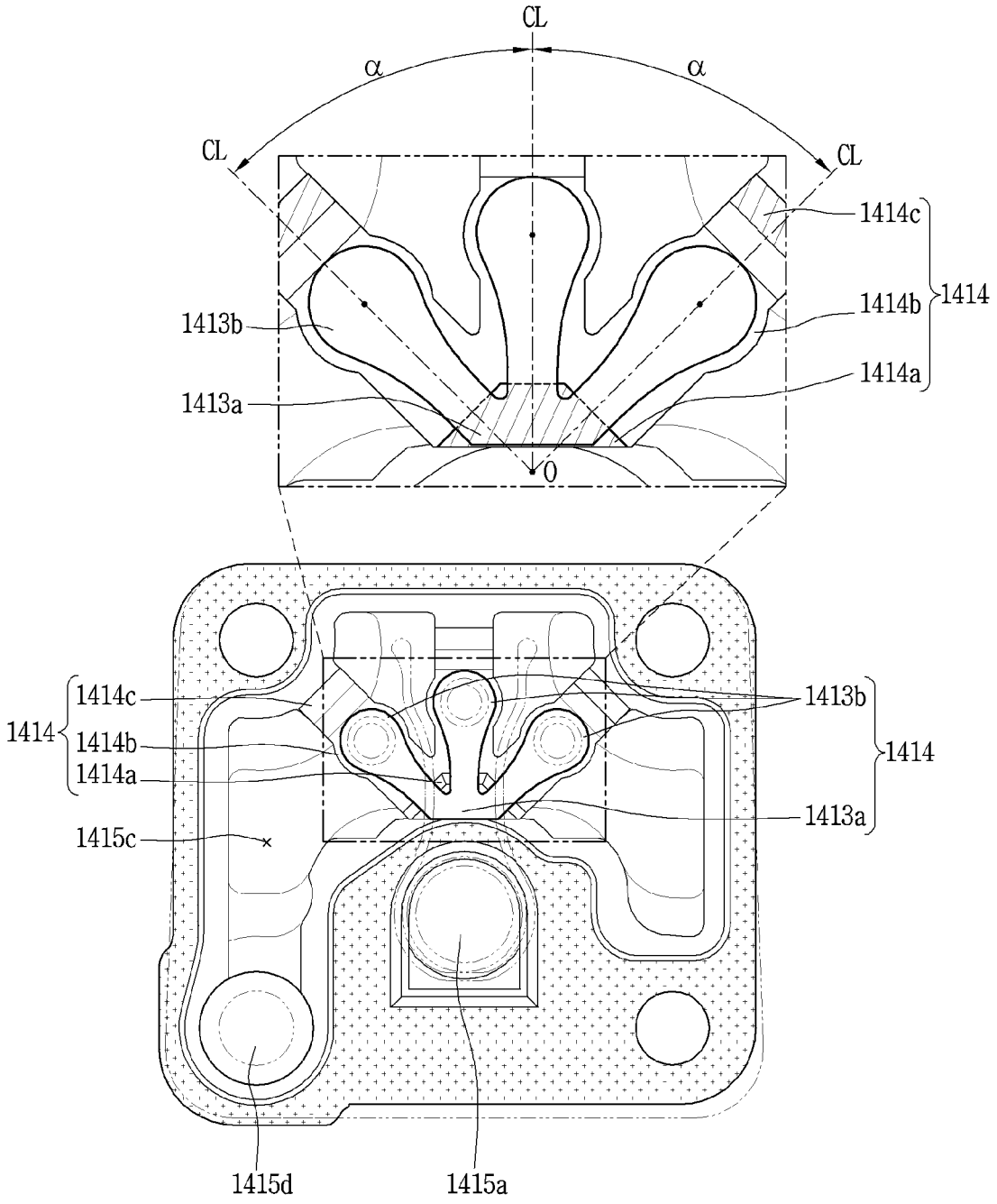
FIG. 7 is a planar view illustrating an assembled state between the discharge valve and a valve stopper (discharge cover) in FIG. 5.

FIG. 5 is a perspective view illustrating components assembled or disassembled to or from the valve assembly in FIG. 3 or FIG. 4. FIG. 6 is a planer view illustrating an assembled state between a valve plate and a discharge valve in FIG. 5. FIG. 7 is a planar view illustrating an assembled state between the discharge valve and a valve stopper (discharge cover) in FIG. 5.

Referring back to FIGS. 3 and 4, the valve assembly 141 may include the valve plate 1411, the suction valve 1412, the discharge valve 1413, the valve stopper 1414, and the discharge cover 1415. The valve plate 1411 and the suction valve 1412 form a suction system, and the valve plate 1411, the discharge valve 1413, the valve stopper 1414, and the discharge cover 1415, excluding the suction valve 1412, form a discharge system. Hereinafter, the discharge system will be mainly described, rather than the suction system. In addition, a side that faces the piston 132 will be referred to as a "first surface", and its opposite side that does not face the piston 132 (or directed opposite to the piston 132) will be referred to as a "second surface".

Referring to FIG. 5, the valve plate 1411 is provided at its center with one suction port 1411*a* that is formed through the first surface and the second surface, and the plurality of discharge ports 1411*b* is provided in the vicinity of the suction port 1411*a* by being formed through the first surface and the second surface. On the second surface of the valve plate 1411, a discharge guide groove 1411*c* may be formed in the periphery of the suction port 1411*a* spaced apart by a predetermined interval, and the plurality of discharge ports

1411*b* may be provided inside of the discharge guide groove 1411*c* spaced apart by predetermined intervals. The smaller a volume of the discharge port 1411*b*, the smaller a dead volume. Thus, the discharge guide groove 1411*c* may be formed as deep as possible to reduce a length of the discharge port 1411*b*, which is advantageous to reduce the dead volume.

The discharge guide groove 1411*c* may have a predetermined substantially arcuate shape to partially surround the suction port 1411*a*, and the plurality of discharge ports 1411*b* may be disposed along the circumferential direction to have substantially the same curvature as the discharge guide groove 1411*c*. A side wall surface of the discharge guide groove 1411*c* may be inclined or curved to reduce flow resistance of refrigerant discharged through the discharge port 1411*b*.

Referring to FIGS. 5 and 6, of side wall surfaces of the discharge guide groove 1411*c*, an inner circumferential surface adjacent to the suction port 1411*a* and an outer circumferential surface that faces the inner circumferential surface may be provided with a valve support portion or support 1411*d* and stopper support portions 1411*e*, respectively. For example, the valve support portion 1411*d* may extend from the inner circumferential surface of the discharge guide groove 1411*c* toward the plurality of discharge ports 1411*b*, and the stopper support portions 1411*e* may extend from the outer circumferential surface of the discharge guide groove 1411*c* toward the plurality of discharge ports 1411*b*.

The valve support portion 1411*d* and the stopper support portion 1411*e* may have substantially a same height as a valve seat surface (no reference numeral) formed along a circumference of an outlet of the discharge port 1411*b*. When the valve seat surface is not provided, the valve support portion 1411*d* and the stopper support portion 1411*e* may also be excluded. However, when a cantilever type reed valve is employed, a valve seat surface is usually provided in a circumference of the discharge port 1411*b*. Hereinafter, an example in which the valve support portion 1411*d* and the stopper support portion 1411*e* are provided together with the valve seat surface will be described.

The valve support portion 1411*d* may be provided to correspond to the fixing portion 1413*a* of the discharge valve 1413. For example, when one fixing portion 1413*a* of the discharge valve 1413 described hereinafter is provided, one valve support portion 1411*d* may be formed at a middle.

The valve support portion 1411*d* may have various shapes. For example, an edge surface of the valve support portion 1411*d* may be formed in an angular or curved shape. However, both sides of the valve support portion 1411*d* may be symmetrical with respect to a longitudinal center line CL of the discharge valve 1413, namely, a longitudinal center line CL of opening and closing portion 1413*b* located at a middle of the opening and closing portions, among longitudinal center lines that respectively pass through the opening and closing portions of the discharge valve.

For example, an edge surface of the valve support portion 1411*d* may include a linear surface 1411*d*1 continuously formed along the circumferential direction as much as the number of opening and closing portions 1413*b* of the discharge valve 1413, and each of the linear surfaces 1411*d*1 may be orthogonal to one of the longitudinal center lines CL of the discharge valve 1413. This may allow the opening and closing portions 1413*b* of the discharge valve 1413 to open and close the respective discharge ports 1411*b* in a fast and accurate manner, thereby increasing compression efficiency.

If the edge surfaces of the valve support portion 1411*d* are asymmetrical with respect to the respective longitudinal center lines CL of the opening and closing portions 1413*b*, viscosity of oil between each opening and closing portion 1413*b* of the discharge valve 1413 and the valve support portion 1411*d* that faces the opening and closing portions 1413*b* acts unevenly or nonuniformly on the opening and closing portions 1413*b*, causing a delay in opening of the discharge valve 1413 or non-uniform opening of the discharge valve 1413. This may also lead to a delay in closing of the discharge valve 1413 or non-uniform closing of the discharge valve 1413. As a result, the discharge port 1411*b* may not be opened and closed quickly and accurately.

However, when the edge surfaces of the valve support portion 1411*d* are symmetrical with respect to the respective opening and closing portions 1413*b*, as in the example described above, resistance in opening and closing, such as oil viscosity, applied to the opening and closing portions 1413*b* of the discharge valve 1413 becomes uniform. That is, as a contact area on both sides of the valve support portion 1411*d* is the same with respect to the longitudinal center line CL of each opening and closing portion 1413*b*, opening and closing resistance may be evenly applied to the opening and closing portions 1412*b*. Then, warping (or twist) of the opening and closing portions 1413*b* does not occur when opening and closing the discharge valve 1413, allowing the discharge valve 1413 to open and close in a constant and stable manner. Accordingly, the discharge valve 1413 may be opened and closed quickly and accurately. Thus, a decrease in compression efficiency in the compression chamber 131*a* due to overshooting may be suppressed, or backflow to the compression chamber 131*a* from the discharge chamber 1415*c* may be suppressed to thereby reduce a suction loss.

Hereinafter, the discharge valve 1413 will be described.

Referring to FIGS. 5 to 7, the discharge valve 1413 may include one fixing portion at the discharge side (fixing portion) 1413*a* and the plurality of opening and closing portions at the discharge side (opening and closing portions) 1413*b*, as described above. The fixing portion 1413*a* may be one in number and have a substantially semicircular shape in plane projection. However, as the plurality of opening and closing portions 1413*b* radially extends from an outer circumferential surface of the fixing portion 1413*a*, a shape of the outer circumferential surface of the fixing portion 1413*a* may not be specifically limited.

The fixing portion 1413*a* may have substantially the same shape as the valve support portion 1411*d* of the valve plate 1411 and the valve pressing portion 1414*a* of the valve stopper 1413, or have at least a similar width to the valve support portion 1411*d* of the valve plate 1411 and the valve pressing portion 1414*a* of the valve stopper 1413. The opening and closing portions 1413*b* may radially extend from an edge of the fixing portion 1413*a*. The opening and closing portions 1413*b* may be provided to correspond to the discharge ports 1411*b*, respectively.

Each of the plurality of opening and closing portions 1413*b* may be divided into a first portion that extends from the fixing portion 1413*a* and a second portion that opens and closes the discharge port 1411*b*. The first portion may be formed in a narrow and long rectangular shape to increase elasticity, and the second portion may be formed in a disk shape that is wide enough to completely cover or block the discharge port 1411*b*. This may allow the opening and closing portions 1413*b* to open and close quickly, and allow the discharge ports 1411*b* to open and close effectively.

The plurality of opening and closing portions 1413*b* may be formed in the same size, namely, symmetrical to each other. For example, the plurality of opening and closing portions 1413*b* may be formed such that the first portions thereof have a same length and width, and the second portions thereof have a same diameter. This may allow the plurality of opening and closing portions 1413*b* to open and close almost simultaneously, thereby preventing a delay in response of one or some of the opening and closing portions 1413*b*. As a result, compression loss, due to overshooting, may be reduced to thereby increase compression efficiency.

In addition, the plurality of opening and closing portions 1413*b* may be formed such that a gap or distance between adjacent opening and closing portions 1413*b* is the same. For example, when three opening and closing portions 1413*b* are provided, they may be symmetrical to each other with respect to a longitudinal center line CL of an opening and closing portion 1413*b* located at the middle thereof.

In other words, the plurality of opening and closing portions 1413*b* may be formed such that angles $\alpha$ formed by two longitudinal center lines CL with respect to a fixing point O where the longitudinal center lines CL of the opening and closing portions 1413*b* meet are the same. Accordingly, an area occupied by the discharge chamber 1415*c* of the discharge cover 1415 may be minimized to thereby increase the number of discharge ports 1411*b* to the maximum. This may result in a further decrease in size of the discharge valve 1413, allowing compression efficiency to be more effectively increased.

Hereinafter, the valve stopper 1414 will be described.

As illustrated in FIGS. 5 and 7, the valve stopper 1414 is similar to the discharge valve 1413, in general. For example, the valve stopper 1414 may be formed such that a plurality of valve limiting (or restricting) portions 1414*b* extends from one valve pressing portion 1414*a*. However, each of the opening and closing portions 1413*b* of the discharge valve 1413 may form a free end with a cantilever shape, whereas each of the valve limiting portions 1414*b* of the valve stopper 1414 may be provided with a stopper fixing portion 1414*c* extending from an end (portion) thereof.

The valve pressing portion 1414*a* may be provided at the first surface that faces the piston 132 to have substantially a same shape as the valve support portion 1411*d* of the valve plate 1411. For example, an edge surface of the valve pressing portion 1414*a* may be formed as a linear surface 1414*a*1 which is orthogonal to the longitudinal center line CL of the discharge valve 1413.

When a plurality of the opening and closing portion 1413*b* of the discharge valve 1413 is provided, the edge surface of the valve pressing portion 1414*a* may be formed such that the linear surface 1414*a*1 is continuously formed along the circumferential direction. This may allow force to be uniformly transmitted to the opening and closing portions 1413*b* of the discharge valve 1413 when opened or closed. Thus, each of the opening and closing portions 1413*b* may be quickly opened and closed.

In some embodiments, as the edge surface of the valve pressing portion 1414*a* is orthogonal to a lengthwise direction of the opening and closing portion 1413*b* of the discharge valve 1413, the opening and closing portions 1413*b* may have a same length except a portion fixed by the valve pressing portion 1414*a*. Then, when inner diameters of the discharge ports 1411*b* are the same, the opening and closing portions 1413*b* of the discharge valve 1413 may be opened and closed almost simultaneously. This may help to prevent a delay in response of the valve, thereby increasing compression efficiency.

The valve limiting portions 1414*b* may be formed in the same number, shape, and direction as the opening and closing portions 1413*b* of the discharge valve 1413. For example, the valve limiting portion 1414*b* may be formed such that a portion that extends from the valve pressing portion 1414*a* is thin and a portion corresponding to the end (second portion) of each opening and closing portion 1413*b* of the discharge valve 1413 is wide. Accordingly, flow resistance of refrigerant generated by the valve limiting portion 1414*b* may be reduced by minimizing a width of the valve limiting portion 1414*b*.

The stopper fixing portion 1414*c* may be provided to correspond to the stopper support portion 1411*e* of the valve plate 1411. For example, when the stopper support portions 1411*e* of the valve plate 1411 are formed individually, the stopper fixing portions 1414*c* may extend from the respective valve limiting portions 1414*b*, and when the stopper support portions 1411*e* of the valve plate 1411 are formed collectively, the stopper fixing portions 1414*c* may be collectively formed by tying a plurality of valve limiting portions 1414*b* together.

Hereinafter, the discharge cover 1415 will be described.

As illustrated in FIGS. 5 and 7, the discharge cover 1415 may accommodate the discharge valve 1413 and the valve stopper 1414 therein so as to be closely fixed to the second surface of the valve plate 1411. Accordingly, the discharge cover 1415 may be provided with the muffler fixing portion 1415*a*, the partition wall portion 1415*b*, the discharge chamber 1415*c*, a discharge passage portion or passage 1415*d*, the first stopper pressing portion 1415*e*, and the second stopper pressing portion 1415*f* formed at the first surface thereof that faces the valve plate 1411.

The muffler fixing portion 1415*a* may be recessed from a middle portion of the first surface of the discharge cover 1415 by a predetermined depth. The partition wall portion 1415*b* may be provided in a circumference of the muffler fixing portion 1415*a* to form the muffler fixing portion 1415*a* in a separate manner.

The discharge chamber 1415*c* may be formed in an arcuate shape along an outside of the muffler fixing portion 1415*a*, namely, an outer circumferential surface of the partition wall portion 1415*b*. The discharge chamber 1415*c* may have a width enough to accommodate the discharge guide groove 1411*c* of the valve plate 1411 therein. Accordingly, refrigerant discharged to the discharge guide groove 1411*c* may be accommodated in the discharge chamber 1415*c*.

The discharge passage portion 1415*d* may extend to one end of the discharge chamber 1415*c* to which the loop pipe 118 is connected. The first stopper pressing portion 1415*e* may extend to an inner circumferential surface of the discharge chamber 1415*c*, namely, a direction to the discharge port 1411*b* from an outer circumferential surface of the discharge chamber 1415*c*. The first stopper pressing portion 1415*e* may have a same shape as the valve support portion 1411*d* of the valve plate 1411 and the valve pressing portion 1414*a* of the valve stopper 1414.

For example, in the first stopper pressing portion 1415*e*, a linear surface 1415*e*1 may be continuously formed along the circumferential direction, and the linear surfaces 1415*e*1 may be formed in a direction orthogonal to the respective longitudinal center lines CL of the discharge valve 1413. Accordingly, the first stopper pressing portion 1415*e* may uniformly press the valve pressing portion 1414*a* of the valve stopper 1414, allowing the fixing portion 1413*a* of the discharge valve 1413 to be securely supported. At the same time, as the opening and closing portions 1413*b* of the discharge valve 1413 are opened and closed in a uniform and balanced manner, a response speed may be increased, allowing the opening and closing portions 1413*b* to open and close quickly.

The second stopper pressing portion 1415*f* may extend in a direction toward the discharge port 1411*b* from the outer circumferential surface of the discharge chamber 1415*c*. The second stopper pressing portion 1415*f* may have substantially the same shape as the stopper fixing portion 1414*c* of the valve stopper 1414.

The valve assembly of the example described above may be assembled as follows.

Figure 8:
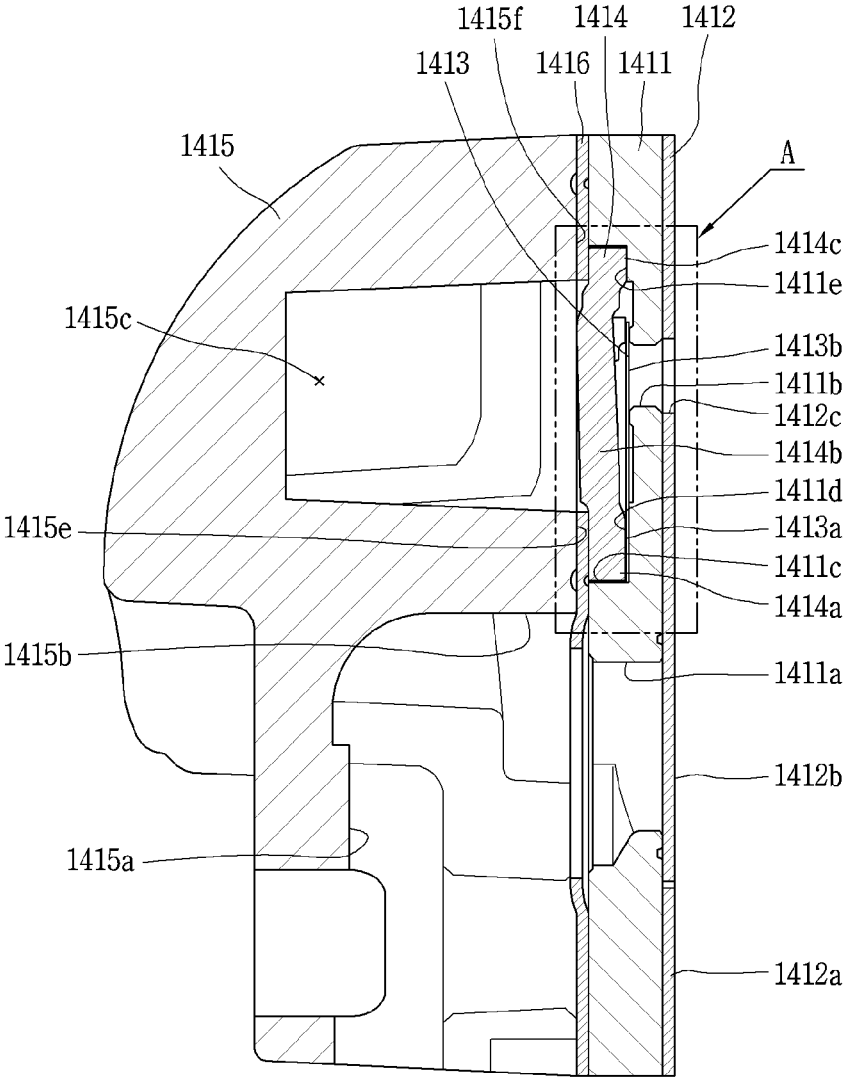
FIG. 8 is a cross-sectional view illustrating an assembled state of a valve assembly according to an embodiment.
Figure 9:
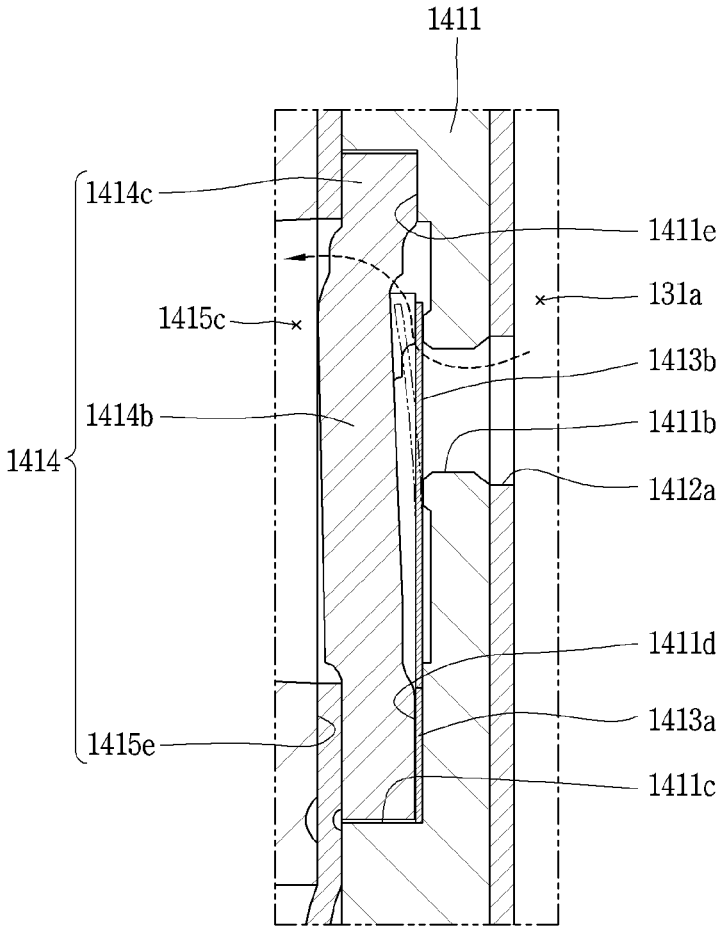
FIG. 9 is an enlarged cross-sectional view of area "A" of FIG. 8.

FIG. 8 is a cross-sectional view illustrating an assembled state of a valve assembly according to an embodiment. FIG. 9 is an enlarged cross-sectional view of area "A" of FIG. 8.

Referring to FIGS. 8 and 9, the fixing portion 1413*a* of the discharge valve 1413 may be in close contact with the valve support portion 1411*d* of the valve plate 1411, and the fixing portion 1413*a* of the discharge valve 1413 may be in close contact with the valve pressing portion 1414*a* of the valve stopper 1414. The valve pressing portion 1414*a* defining one or a first end of the valve stopper 1414 may be fixed to the valve plate 1411 by the first stopper pressing portion 1415*e* of the discharge cover 1415, and the stopper fixing portion 1414*c* defining another or a second end of the valve stopper 1411 may be fixed to the valve plate 1411 by the second stopper pressing portion 1415*f* of the discharge cover 1415 while being in close contact with the stopper support portion 1411*e* of the valve plate 1411. Accordingly, the fixing portion 1413*a* of the discharge valve 1413 may be pressed by the valve stopper 1414 and may be fixed to the valve plate 1411 between the valve support portion 1411*d* of the valve plate 1411 and the valve pressing portion 1414*a* of the valve stopper 1414. That is, the fixing portion 1413*a* of the discharge valve 1413 may be fixed by the valve stopper 1414 which is pressed by force of fastening the discharge cover 1415 to the cylinder block 131.

The opening and closing portion 1413*b* of the discharge valve 1413 defines a free end with respect to the valve stopper 1414, and a degree of opening is limited or restricted by the valve limiting portion 1414*b* of the valve stopper 1414. The stopper fixing portion 1414*c* is pressed by the second stopper pressing portion 1415*f* of the discharge cover 1415 to be in close contact with the valve plate 1411, allowing both ends thereof are fixed to thereby more stably support opening operation of the discharge valve 1413 when opened.

In the valve assembly of the example described above, the plurality of opening and closing portions extends from one fixing portion in an integrated manner, and thus, small(er) diameters of the discharge ports may be achieved, and the opening and closing portions of the discharge valve may be reduced in size. As a result, inertia of the valve may be reduced to thereby increase response of the discharge valve while simplifying its structure and assembly.

Figure 10:
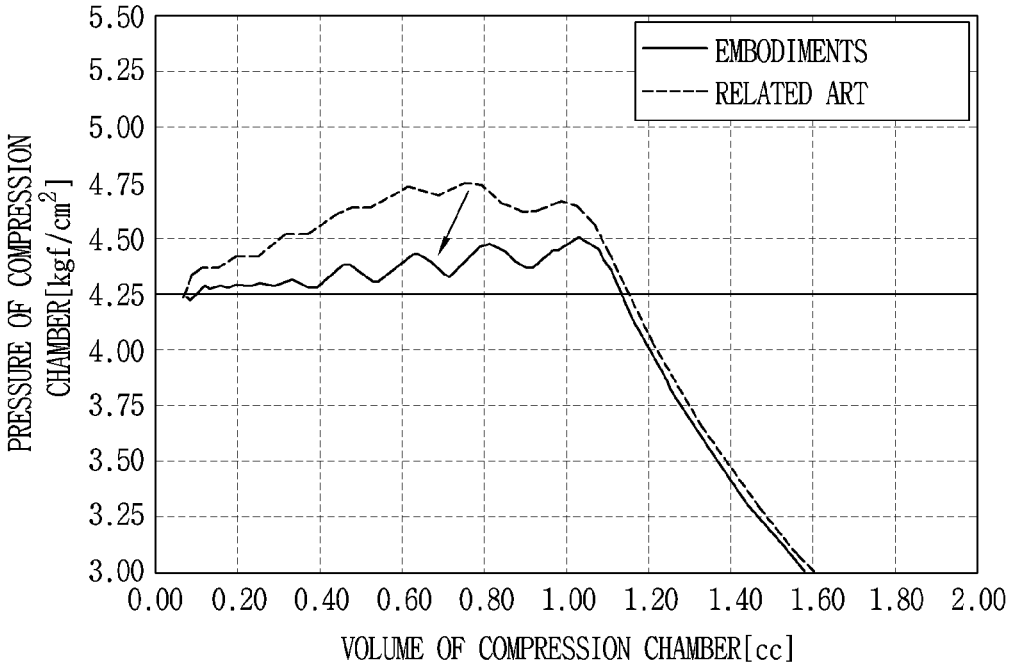
FIG. 10 is a graph showing compression loss reduction in a valve assembly according to an embodiment by comparing it with a valve assembly according to the related art.

FIG. 10 is a graph showing compression loss reduction in a valve assembly according to an embodiment by comparing it with a valve assembly according to the related art. Referring to FIG. 10, in the case of the related art valve assembly with one discharge port (or opening and closing portion of the discharge valve), it can be seen that pressure of a compression chamber, represented by a dotted line, greatly exceeds a discharge pressure of 4.25, namely, an overshoot state (overshooting). As only one opening and closing portion of the discharge valve is provided, inertia of the valve increases, which causes a delay in response of the valve. As a result, a significant amount of refrigerant remains compressed without being discharged from the compression chamber when it reaches a proper discharge pressure.

In contrast, as for the valve assembly according to embodiments having a plurality of discharge ports (or opening and closing portions of the discharge valve), it exhibits a reduced degree of overshooting than the related art. As it can be seen from the graph, pressure of a compression chamber according to embodiments, indicated by a solid line, is lower than that of the related art at exceeding the discharge pressure of 4.25. As the opening and closing portion of the discharge valve is divided into a plurality of portions, inertia of the discharge valve is reduced. This may result in an increase in response of the valve, allowing the discharge valve to open and close quickly to thereby reduce a loss due to overshooting.

Further, in some embodiments, the valve support portion 1411*d*, the valve pressing portion 1414*a*, and the first stopper pressing portion 1415*e* uniformly support the fixing portion 1413*a* of the discharge valve 1413, thereby enabling the opening and closing portions 1413*b* of the discharge valve 1413 to be opened and closed in a uniform and balanced manner while allowing the discharge valve 1413 to be more quickly opened and closed. In the valve assembly according to some embodiments, the plurality of opening and closing portions radially extends from one fixing portion, and thus, the opening and closing portions of the discharge valve may be reduced in size, allowing response of the valve to be increased while simplifying its structure and assembly.

In addition, in the discharge valve according to some embodiments, the plurality of opening and closing portions may radially extend from one fixing portion to be symmetrical with respect to a longitudinal center line of an opening and closing portion located at the middle thereof. This may allow the opening and closing portion of the discharge valve to be divided into a plurality (portions) while enabling the opening and closing portions to open and close simultaneously. Thus, response of the valve may be further increased.

Further, as the edge surface of the valve support portion that supports the discharge valve and the edge surface of the valve pressing portion are symmetrical with respect to the longitudinal center line of the discharge valve, the opening and closing portions are uniformly supported, allowing the discharge valve to open and close in a constant and stable manner without being twisted or warped. Accordingly, refrigerant in the compression chamber may be discharged more quickly through the plurality of discharge ports. Thus, overshooting of refrigerant compressed in the compression chamber may be suppressed, allowing compression efficiency to be increased.

In some embodiments, the valve support portion 1411*d* of the valve plate 1411, the valve pressing portion 1414*a* of the valve stopper 1414, and the first stopper pressing portion 1415*e* of the discharge cover 1415 may be provided as follows. That is, in the example described above, the valve support portion 1411*d* of the valve plate 1411, the valve pressing portion 1414*a* of the valve stopper 1414, and the first stopper pressing portion 1415*e* of the discharge cover 1415 are provided to correspond to each other, and each of them is formed as a linear surface orthogonal to one of the opening and closing portions 1413*b* of the discharge valve 1413, but in some cases, these members may be formed as curved surfaces. As the valve support portion 1411*d* of the valve plate 1411, the valve pressing portion 1414*a* of the valve stopper 1414, and the first stopper pressing portion 1415*e* of the discharge cover 1415 are identically formed to each other, the valve support portion 1411*d* of the valve plate 1411 will be described as a representative example. Descriptions of the valve pressing portion 1414*a* of the valve stopper 1414 and the first stopper pressing portion 1415*e* of the discharge cover 1415 will be replaced with the description of the valve support portion 1411*d* of the valve plate 1411.

Figure 11:
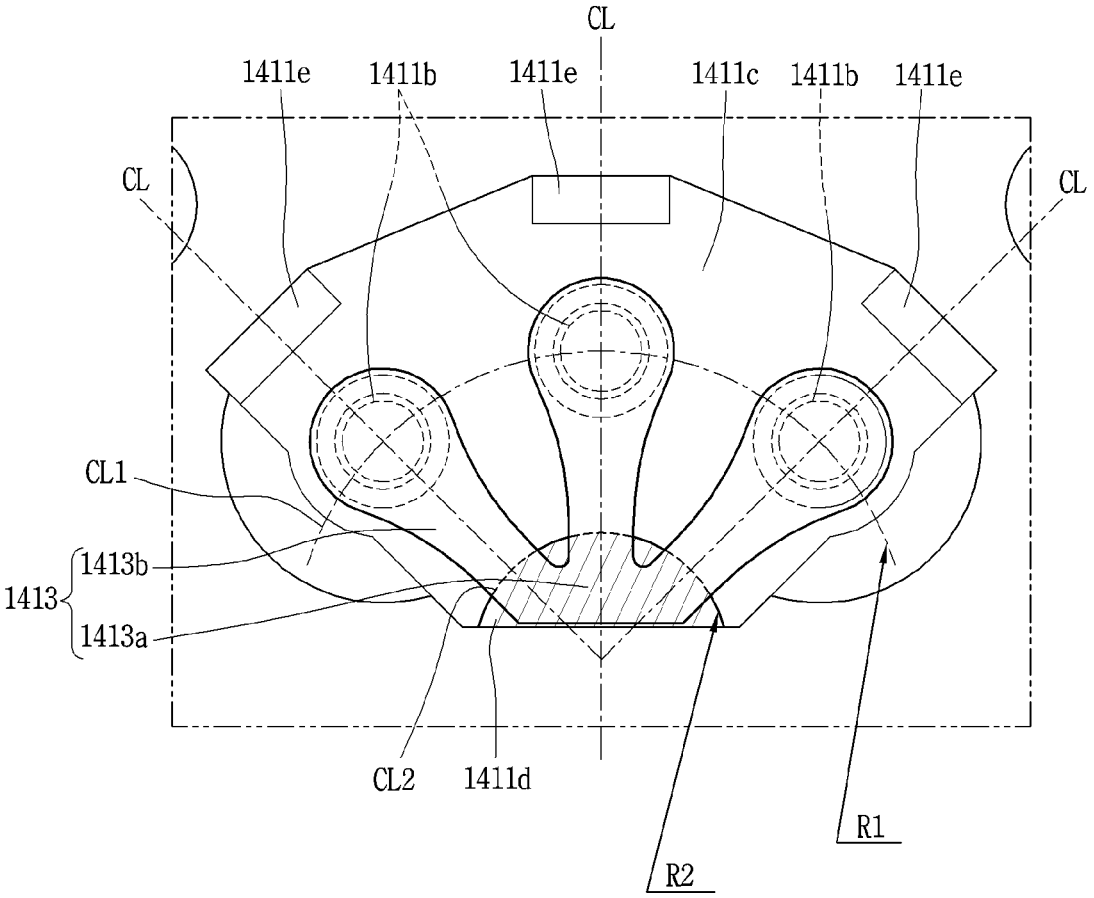
FIG. 11 is a schematic view of a support structure of a discharge valve in a valve assembly according to an embodiment.

FIG. 11 is a schematic view illustrating an example of a support structure of a discharge valve in the valve assembly. As illustrated in FIG. 11, the valve support portion 1411*d* of the valve plate 1411 may have a semicircular shape. For example, an edge surface of the valve support portion 1411*d* may be formed as a curved surface 1411*d*2 having a semicircular shape.

Even in this case, the edge surface of the valve support portion 1411*d* may be located at a same distance from each discharge port 1411*b*. In other words, when a virtual line that connects centers of the plurality of discharge ports 1411*b* is referred to as a "first virtual line CL1", a virtual line that connects the edge surface of the valve support portion 1411*d* is referred to as a "second virtual line CL2", a curvature R1 of the first virtual line CL1 may be equal to a curvature R2 of the second virtual line CL2.

Then, the edge surface of the valve support portion 1411*d* that defines the second virtual line CL2 is symmetrical with respect to a longitudinal center line CL of an opening and closing portion 1413*b* located at a middle of the opening and closing portions 1413*b* of the discharge valve 1413, among longitudinal center lines CL. This may also have the same effect described in the example of FIG. 5. That is, as the opening and closing portions 1413*b* of the discharge valve 1413 are opened and closed in a uniform and balanced manner, a response speed of the valve is increased. Thus, a compression loss due to overshooting may be reduced, and suction loss caused by backflow may be reduced.

Embodiments disclosed herein provide a hermetic compressor that can be easily manufactured and assembled by simplifying a structure of a discharge valve while increasing response (speed) of the discharge valve by reducing inertia thereof. Embodiments disclosed herein further provide a hermetic compressor that can divide an opening and closing portion of a discharge valve into a plurality of opening and closing portions while synchronizing opening and closing operations of the plurality of opening and closing portions of the discharge valve. Embodiments disclosed herein furthermore provide a hermetic compressor that can suppress overshooting and increase compression efficiency by evenly or uniformly supporting a plurality of opening and closing portions to synchronize opening and closing operations of the plurality of opening and closing portions of a discharge valve.

Embodiments disclosed herein provide a hermetic compressor that may include a plurality of discharge ports and one discharge valve having a plurality of opening and closing portions that opens and closes the plurality of discharge ports, respectively. Accordingly, inertia of the discharge valve may be reduced to thereby increase its response speed, and a structure of the discharge valve may be simplified to thereby facilitate manufacture and assembly of the discharge valve.

Embodiments disclosed herein may include one or more of the following features. For example, the discharge valve may have a plurality of opening and closing portions that radially extends from one fixing portion. This may allow the opening and closing portions to be reduced in size, thereby lowering inertia of the valve. Thus, response of the discharge valve may be increased while simplifying a structure and assembly of the discharge valve.

Embodiments disclosed herein provide a hermetic compressor that may include a plurality of discharge ports and a discharge valve having a plurality of opening and closing portions that respectively opens and closes the plurality of discharge ports, extends from one fixing portion, and is symmetrical to each other. This may allow an opening and closing portion of the discharge valve to be divided into a plurality of opening and closing portions while synchronizing opening and closing operations of the discharge valve.

Embodiments disclosed herein include one or more of the following features. For example, the plurality of opening and closing portions may radially extend from the fixing portion, and be symmetrical with respect to a longitudinal center line of an opening and closing portion located at a middle of the plurality of opening and closing portions. This may allow an opening and closing portion of the discharge valve to be divided into a plurality of opening and closing portions while synchronizing opening and closing operations of the plurality of opening and closing portions.

Embodiments disclosed herein provide a hermetic compressor that may include a valve plate having a plurality of discharge ports; a discharge valve that is supported by the valve plate to open and close the plurality of discharge ports; and a valve stopper that presses the discharge valve to make the discharge valve supported on the valve plate. The valve plate and the valve stopper may each have a valve support portion or support that supports the fixing portion of the discharge valve and a valve pressing portion, and the valve support portion and the valve pressing portion may be symmetrical to each other. Accordingly, the plurality of opening and closing portions may be evenly supported, allowing the discharge valve to be opened and closed in a uniform manner. As a result, overshooting may be suppressed or reduced to thereby increase compression efficiency.

Embodiments disclosed herein may include one or more of the following features. For example, an edge surface of the valve support portion and an edge surface of the valve pressing portion may be symmetrical with respect to a longitudinal center line that passes through one of the opening and closing portions of the discharge valve. Accordingly, each of the opening and closing portions may be evenly supported, allowing the discharge valve to be opened and closed in a constant and stable manner without causing warping.

Embodiments disclosed herein provide a hermetic compressor that may include a cylinder in which a compression chamber is formed; a valve assembly provided at a front end of the cylinder to cover the compression chamber; and a discharge cover coupled to the valve assembly at an opposite side of the cylinder with the valve assembly interposed therebetween. The valve assembly may include a valve plate having one suction port and a plurality of discharge ports; a suction valve provided at a first surface of the valve plate that faces the compression chamber; a discharge valve provided at a second surface of the valve plate opposite to the first surface thereof, and having one fixing portion and a plurality of opening and closing portions that extends from the one fixing portion so as to respectively open and close the plurality of discharge ports; and a valve stopper provided between the valve plate and the discharge cover with the discharge valve interposed therebetween to be fixed to the valve plate together with the discharge valve by being pressed by the discharge cover, and limiting a degree of opening of the opening and closing portions of the discharge valve. This may allow inertia of the discharge valve to be reduced to thereby increase response of the discharge valve while simplifying its structure and assembly.

Embodiments disclosed herein may include one or more of the following features. For example, the valve plate may be provided with a valve support portion or support that supports the fixing portion of the discharge valve, and an edge surface of the valve support portion may be symmetrical with respect to a longitudinal center line of an opening and closing portion located at a middle of the plurality of opening and closing portions, among longitudinal center lines that respectively pass through the opening and closing portions of the discharge valve. This may allow an opening and closing portion of the discharge valve to be divided into a plurality of opening and closing portions while enabling the opening and closing portions to open and close simultaneously. Thus, response of the valve may be further increased.

In some embodiments, the edge surface of the valve support portion may include a plurality of linear surfaces continuously formed along a circumferential direction, and each of the plurality of linear surfaces may be orthogonal to one of the longitudinal center lines. Accordingly, the opening and closing portions may be evenly supported to thereby support the discharge valve in a constant and secure manner without causing warping of the discharge valve. This may allow refrigerant in the compression chamber to be more quickly discharged through the plurality of discharge ports, thereby preventing overshooting of refrigerant compressed in the compression chamber. Thus, compression efficiency may be increased.

In some embodiments, the edge surface of the valve support portion may be formed as a curved surface. A curvature of the curved surface may be the same as a curvature of a first virtual line that connects centers of the plurality of discharge ports in a circumferential direction.

In some embodiments, stopper support portions or supports may be provided at an opposite side of the valve support portion with the plurality of discharge ports interposed therebetween. Each of the stopper support portions may be located on one of the longitudinal center lines.

In some embodiments, one discharge guide groove may be formed on the valve plate to surround the plurality of discharge ports. The valve support portion and the stopper support portions may extend from an inner circumferential surface of the discharge guide groove toward the plurality of discharge ports, respectively.

In some embodiments, the valve stopper may be provided with one valve pressing portion that presses the fixing portion of the discharge valve to be fixed to the valve support portion of the valve plate. An edge surface of the valve support portion may be symmetrical with respect to a longitudinal center line of an opening and closing portion located at a middle of the plurality of opening and closing portions, among longitudinal center lines that respectively pass through the opening and closing portions of the discharge valve.

In some embodiments, the edge surface of the valve pressing portion may include a plurality of linear surfaces continuously formed along a circumferential direction. Each of the plurality of linear surfaces may be orthogonal to one of the longitudinal center lines.

In some embodiments, the edge surface of the valve pressing portion may be formed as a curved surface. A curvature of the curved surface may be the same as a curvature of a first virtual line that connects centers of the plurality of discharge ports in a circumferential direction.

In some embodiments, the valve stopper may be provided with a valve limiting portion that radially extends from the valve pressing portion and a stopper fixing portion that extends from the valve limiting portion to define an end portion of the valve stopper. The valve pressing portion and the stopper fixing portion may be fixed to the valve plate by being pressed by the discharge cover.

In some embodiments, the valve plate may be provided with a valve support portion or support that supports the fixing portion of the discharge valve, and the valve stopper may be provided with a valve pressing portion that presses the fixing portion of the discharge valve to be supported on the valve plate. The valve support portion and the valve pressing portion may be symmetrical to each other.

In some embodiments, an edge surface of the valve support portion and an edge surface of the valve pressing portion may be symmetrically with respect to a longitudinal center line of an opening and closing portion located at a middle of the plurality of opening and closing portions, among longitudinal center lines that respectively pass through the opening and closing portions of the discharge valve.

In some embodiments, the discharge valve may be formed such that the plurality of opening and closing portions may radially extend from the one fixing portion. The plurality of opening and closing portions may be formed such that adjacent opening and closing portions are symmetrical to each other. The plurality of opening and closing portions may be symmetrical with respect to the longitudinal center line that passes through the opening and closing portion located at a middle thereof. Each of the plurality of opening and closing portions may be symmetrical with respect to one of center lines that pass through a center of the fixing portion.

The foregoing description has been given of embodiments. However, the embodiments may be implemented in various forms without departing from the spirit or essential characteristics thereof, and thus, the embodiments described above should not be limited by the detailed description provided herein.

Moreover, even if any embodiment is not specifically disclosed in the foregoing detailed description, it should be broadly construed within the scope of the technical spirit, as defined in the accompanying claims. Furthermore, all modifications and variations that fall within the metes and bounds of the claims, or equivalents of such metes and bounds are therefore intended to be embraced by the appended claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A hermetic compressor, comprising:

a cylinder in which a compression chamber is formed;

a valve assembly provided at a front end of the cylinder to cover the compression chamber; and a discharge cover coupled to the valve assembly at an opposite side to the cylinder with the valve assembly interposed therebetween, wherein the valve assembly comprises:

a valve plate having one suction port and a plurality of discharge ports;

a suction valve provided at a first surface of the valve plate that faces the compression chamber;

a discharge valve provided at a second surface of the valve plate opposite to the first surface thereof, and having a fixing portion and a plurality of opening and closing portions that extends from the fixing portion so as to respectively open and close the plurality of discharge ports; and a valve stopper provided between the valve plate and the discharge cover with the discharge valve interposed therebetween to be fixed to the valve plate together with the discharge valve by being pressed by the discharge cover, and limiting a degree of opening of the plurality of opening and closing portions of the discharge valve, wherein the valve plate includes a discharge guide groove that accommodates the plurality of discharge ports and a valve support that supports one side of the fixing portion of the discharge valve, wherein the valve support extends from an inner circumferential surface of the discharge guide groove toward the plurality of discharge ports, and wherein a height of the valve support is formed to be smaller than a depth of the discharge guide groove.

2. The compressor of claim 1, wherein an edge surface of the valve support is symmetrical with respect to a longitudinal center line of an opening and closing portion located at a middle of one of the plurality of opening and closing portions, among longitudinal center lines that respectively pass through the plurality of opening and closing portions of the discharge valve.

3. The compressor of claim 2, wherein the edge surface of the valve support includes a plurality of linear surfaces continuously formed along a circumferential direction, and wherein each of the plurality of linear surfaces is orthogonal to one of the longitudinal center lines.

4. The compressor of claim 2, wherein the edge surface of the valve support is formed as a curved surface, and wherein a curvature of the curved surface is the same as a curvature of a first virtual line that connects centers of the plurality of discharge ports in a circumferential direction.

5. The compressor of claim 2, wherein a plurality of stopper supports is provided at an opposite side of the valve support with the plurality of discharge ports interposed therebetween, and wherein each of the plurality of stopper supports is located on one of the longitudinal center lines.

6. The compressor of claim 5, wherein the plurality of stopper supports extend extends from an inner circumferential surface of the discharge guide groove toward the plurality of discharge ports, respectively.

7. The compressor of claim 1, wherein the valve stopper includes a valve pressing portion that presses the fixing portion of the discharge valve to be fixed to the valve support of the valve plate, and wherein an edge surface of the valve support is symmetrical with respect to a longitudinal center line of an opening and closing portion located at a middle of one of the plurality of opening and closing portions, among longitudinal center lines that respectively pass through the plurality of opening and closing portions of the discharge valve.

8. The compressor of claim 7, wherein the edge surface of the valve pressing portion includes a plurality of linear surfaces continuously formed along a circumferential direction, and wherein each of the plurality of linear surfaces is orthogonal to one of the longitudinal center lines.

9. The compressor of claim 7, wherein the edge surface of the valve pressing portion is formed as a curved surface, and wherein a curvature of the curved surface is the same as a curvature of a first virtual line that connects centers of the plurality of discharge ports in a circumferential direction.

10. The compressor of claim 7, wherein the valve stopper includes a valve limiting portion that radially extends from the valve pressing portion and a stopper fixing portion that extends from the valve limiting portion to define an end portion of the valve stopper, and wherein the valve pressing portion and the stopper fixing portion are fixed to the valve plate by being pressed by the discharge cover.

11. The compressor of claim 1, wherein the valve plate includes a valve support that supports the fixing portion of the discharge valve, wherein the valve stopper includes a valve pressing portion that presses the fixing portion of the discharge valve to be supported on the valve plate, and wherein the valve support and the valve pressing portion are symmetrical to each other.

12. The compressor of claim 11, wherein an edge surface of the valve support and an edge surface of the valve pressing portion are symmetrical with respect to a longitudinal center line of an opening and closing portion located at a middle of one of the plurality of opening and closing portions, among longitudinal center lines that respectively pass through the plurality of opening and closing portions of the discharge valve.

13. The compressor of claim 1, wherein the plurality of opening and closing portions radially extends from the fixing portion.

14. The compressor of claim 13, wherein adjacent opening and closing portions of the plurality of opening and closing portions are symmetrical to each other.

15. The compressor of claim 13, wherein the plurality of opening and closing portions is symmetrical with respect to a longitudinal center line that passes through an opening and closing portion of the plurality of opening and closing portions located at a middle thereof.

16. The compressor of claim 13, wherein each of the plurality of opening and closing portions is symmetrical with respect to one of center lines that pass through a center of the fixing portion.

17. A hermetic compressor, comprising:

a cylinder in which a compression chamber is formed;

a valve assembly provided at a front end of the cylinder to cover the compression chamber; and a discharge cover coupled to the valve assembly at an opposite side to the cylinder with the valve assembly interposed therebetween, wherein the valve assembly comprises:

a valve plate having one suction port and a plurality of discharge ports;

a suction valve provided at a first surface of the valve plate that faces the compression chamber;

a discharge valve provided at a second surface of the valve plate opposite to the first surface thereof, the discharge valve including a fixed end and a plurality of flaps that extends radially from the fixed end, the plurality of flaps being configured respectively to open and close the plurality of discharge ports; and a valve stopper provided between the valve plate and the discharge cover with the discharge valve interposed therebetween to be fixed to the valve plate together with the discharge valve by being pressed by the discharge cover, and limiting a degree of opening of the plurality of flaps of the discharge valve, wherein the valve plate includes a discharge guide groove that accommodates the plurality of discharge ports and a valve support that supports one side of the fixed end of the discharge valve, wherein the valve support extends from an inner circumferential surface of the discharge guide groove toward the plurality of discharge ports, wherein the valve stopper includes a valve pressing portion that presses another side of the fixed end of the discharge valve toward the valve support to be fixed onto the valve support of the valve plate, and wherein a height of the valve support and a height of the valve stopper are respectively formed to be smaller than a depth of the discharge guide groove.

18. The compressor of claim 17, wherein adjacent flaps of the plurality of flaps are symmetrical to each other.

19. The compressor of claim 17, wherein the plurality of flaps is symmetrical with respect to a longitudinal center line that passes through a flap of the plurality of flaps located at a middle thereof.

20. The compressor of claim 17, wherein each of the plurality of flaps is symmetrical with respect to one of center lines that passes through a center of the fixed end.

* * * * *